US009753410B2

(12) United States Patent
Uehara

(10) Patent No.: US 9,753,410 B2
(45) Date of Patent: Sep. 5, 2017

(54) DEVELOPING DEVICE AND IMAGE FORMING APPARATUS THAT GENERATE PREVENTION BIAS FOR SUPPRESSING SCATTERING OF DEVELOPER

(71) Applicant: CANON KABUSHIKI KAISHA, Tokyo (JP)

(72) Inventor: Takashi Uehara, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 30 days.

(21) Appl. No.: 14/708,482

(22) Filed: May 11, 2015

(65) Prior Publication Data

US 2015/0338779 A1 Nov. 26, 2015

(30) Foreign Application Priority Data

May 21, 2014 (JP) ..... 2014-105668

(51) Int. Cl.
*G03G 15/06* (2006.01)
*G03G 15/09* (2006.01)

(52) U.S. Cl.
CPC ..... *G03G 15/0907* (2013.01); *G03G 15/065* (2013.01)

(58) Field of Classification Search
USPC ..... 399/55, 271
See application file for complete search history.

(56) References Cited

U.S. PATENT DOCUMENTS 5,581,336 A 12/1996 Matsuzaki et al.
7,957,681 B2 * 6/2011 Shigehiro ..... G03G 15/09 399/119

FOREIGN PATENT DOCUMENTS

JP 3131345 B2 1/2001
JP 3177090 B2 6/2001

* cited by examiner

*Primary Examiner* — Minh Phan
(74) *Attorney, Agent, or Firm* — Fitzpatrick, Cella, Harper & Scinto

(57) ABSTRACT

A developing device for developing an electrostatic latent image on an image carrier by using developer includes a developing bias output unit configured to output a developing bias generated by superimposing an AC bias on a DC bias, a developing sleeve supplied with the developing bias output from the developing bias output unit, and a prevention bias generator unit configured to generate a prevention bias by holding a peak value of the developing bias of the superimposed AC bias and DC bias, with the prevention bias suppressing scattering of developer carried by the developing sleeve. In addition, an electrode is disposed at a position opposing the developing sleeve and configured to output the prevention bias.

9 Claims, 6 Drawing Sheets

FIG. 6
| | $V_{p-p}$ | Vd | Vo | Vh |
|---|---|---|---|---|
| PREVENTION BIAS GENERATOR CIRCUIT 400 | 1600V | -800V | -1440V | 640V |
| | 1200V | -800V | -1260V | 460V |
| PREVENTION BIAS GENERATOR CIRCUIT 900 | 1600V | -800V | -1440V | 640V |
| | 1200V | -800V | -1080V | 280V |
FIG. 7
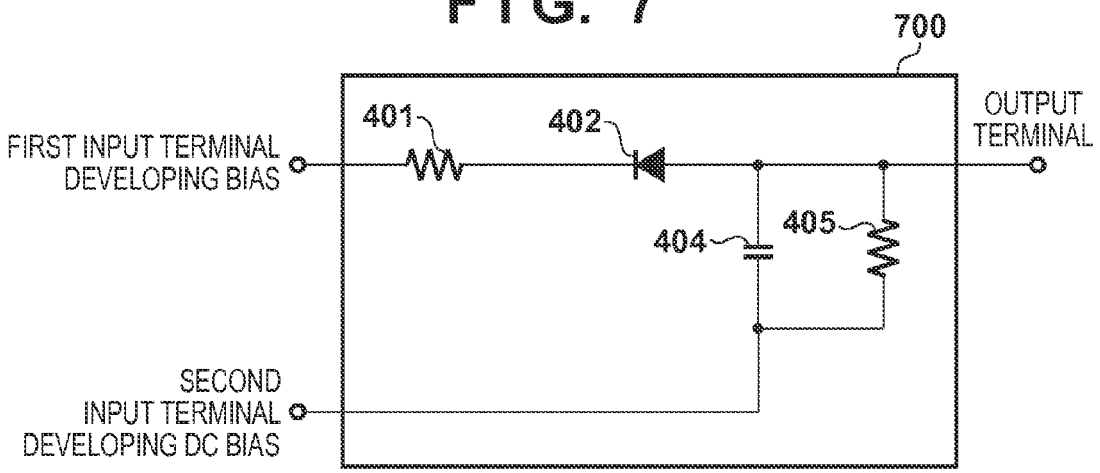
FIG. 8
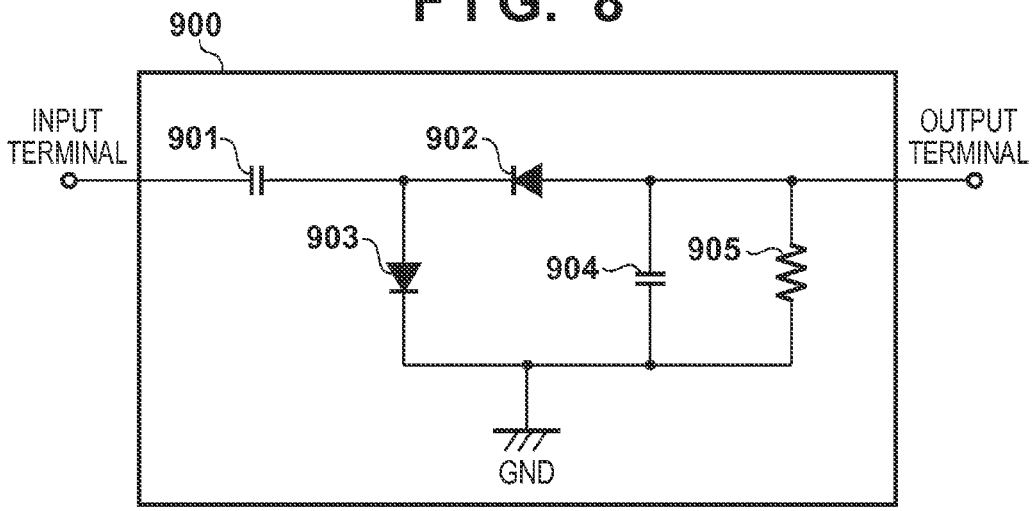

DEVELOPING DEVICE AND IMAGE FORMING APPARATUS THAT GENERATE PREVENTION BIAS FOR SUPPRESSING SCATTERING OF DEVELOPER

BACKGROUND OF THE INVENTION

Field of the Invention

The present invention relates to technology of generating a bias, applicable to a developing device of an image forming apparatus.

Description of the Related Art

In a developing device of an image forming apparatus, developer housed within a developer container is carried and conveyed by a developing sleeve disposed near the opening of the container, and the developer is caused to adhere to an electrostatic latent image formed on the surface of a photosensitive member. Thus, the electrostatic latent image is developed as a visible image. In this regard, a portion of the developer, carried and conveyed by the developing sleeve but not used for the development, is conveyed to the developer container via a gap between the outer circumferential surface of the developing sleeve and the inside surface of the developer container, and is collected in the developer container. In order to prevent the developer from going out of the developer container via the gap and being scattered outside the developing device, U.S. Pat. No. 5,581,336 discloses a configuration in which an electrode (prevention electrode) is provided at a position located inside the developer container and opposing the developing sleeve. This configuration prevents or suppresses the scattering of developer by applying a bias (hereinafter, "prevention bias") to the prevention electrode and thereby applying a force on the developer in the direction toward the developing sleeve.

As the prevention bias applied to the prevention electrode is generated from a developing bias applied to the developing sleeve, it is unnecessary to provide an additional high-voltage power supply dedicated to the purpose of generating the prevention bias. FIG. 8 is a diagram showing a configuration of a prevention bias generator circuit 900 that generates a prevention bias from a developing bias. The input terminal of the prevention bias generator circuit 900 is supplied with a developing bias generated by superimposing an AC voltage on a DC voltage. Note that in the following description, the DC component of a developing bias is referred to as "developing DC bias" and the AC component of a developing bias is referred to as "developing AC bias". A coupling capacitor 901 blocks the developing DC bias and allows the developing AC bias to pass through it. Diodes 902 and 903, a capacitor 904, and a bleeder resistor 905 constitute a voltage doubling rectifier circuit, so that a negative bias that is equal to the peak-to-peak value of the developing AC bias is output from the output terminal and serves as prevention bias Vo. Note that the output negative bias in reality is approximately 0.9 times the peak-to-peak value of the developing AC bias due to the occurrence of a forward voltage drop across the diode 902 and a voltage drop across the bleeder resistor 905.

FIG. 9 shows the relationship among the developing DC bias, the developing AC bias, and the prevention bias in the prevention bias generator circuit 900. In FIG. 9, the developing DC bias is Vd, and the peak-to-peak value of the developing AC bias is Vpp. As described above, the prevention bias generator circuit 900 outputs a negative bias that is approximately 0.9 times the value of Vpp. In other words, the absolute value of the prevention bias Vo is approximately Vpp×0.9. In order to apply a force on the developer in the direction toward the developing sleeve by the prevention bias, the prevention bias needs to be negative as is the developing DC bias, and the absolute value thereof needs to be greater than the absolute value of the developing DC bias by a predetermined amount or more. In other words, the potential difference Vh=|Vo−Vd| needs to be equal to or greater than a predetermined value. However, the developing AC bias and the developing DC bias vary depending on the environment in which the image forming apparatus is installed, the length of the period of use of the apparatus, the printing mode, etc. The prevention bias Vo output by the prevention bias generator circuit 900 decreases as the developing AC bias decreases, and therefore there is the possibility that the potential difference Vh would be smaller than the required amount.

SUMMARY OF THE INVENTION

According to an aspect of the present invention, a developing device for developing an electrostatic latent image on an image carrier by using developer, includes: a developing bias output unit configured to output a developing bias generated by superimposing an AC bias on a DC bias; a developing sleeve supplied with the developing bias output from the developing bias output unit; a prevention bias generator unit configured to generate a prevention bias by holding a peak value of the developing bias, the prevention bias suppressing scattering of developer carried by the developing sleeve; and an electrode, disposed at a position opposing the developing sleeve, configured to output the prevention bias.

Further features of the present invention will become apparent from the following description of exemplary embodiments with reference to the attached drawings.

BRIEF DESCRIPTION OF THE DRAWINGS

FIG. 6 is a diagram showing an example of a developing AC bias and a potential difference Vh in each prevention bias generator circuit.

FIG. 7 is a diagram showing a configuration of a prevention bias generator circuit according to an embodiment.

FIG. 8 is a diagram showing a configuration of a prevention bias generator circuit according to a conventional example.

DESCRIPTION OF THE EMBODIMENTS

Figure 1:
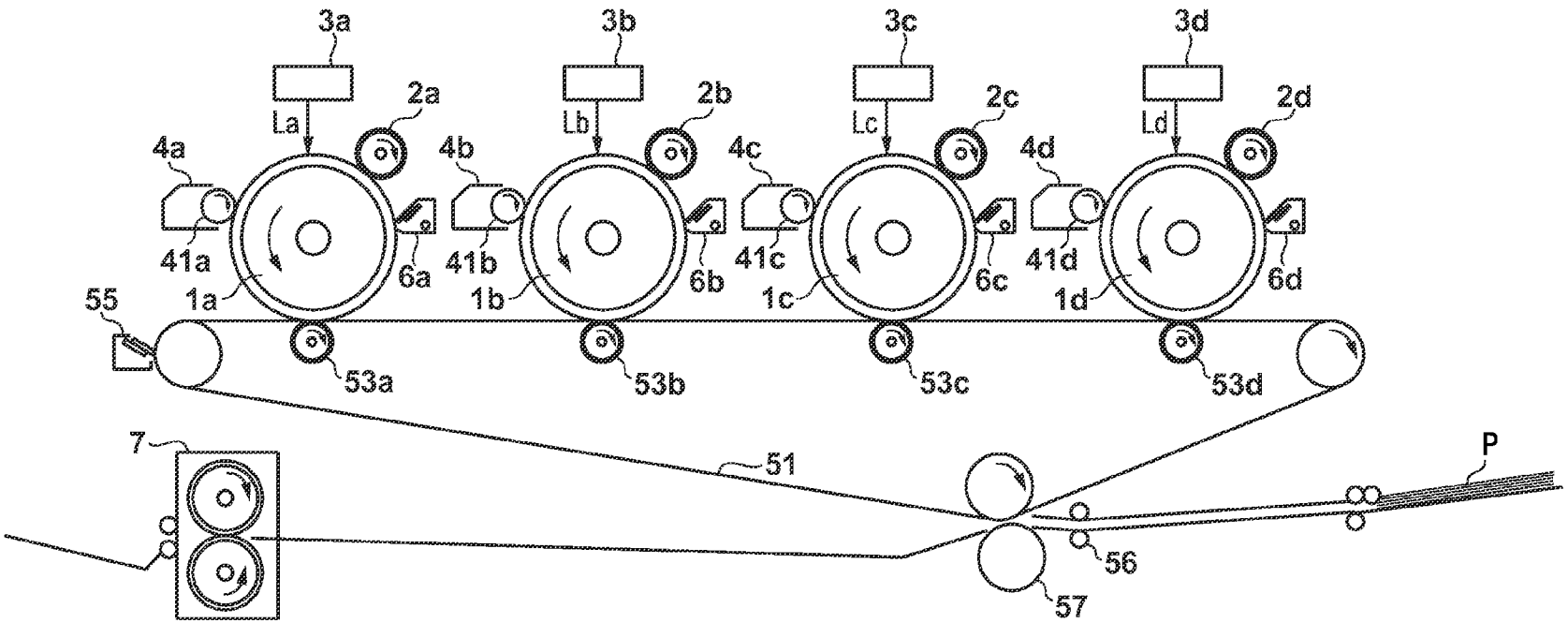
FIG. 1 is a diagram showing an overall configuration of an image forming apparatus according to an embodiment.

Illustrative embodiments of the present invention will be described below with reference to the drawings. Note that the following embodiments are illustrative, and the scope of the present invention is not intended to be limited to the content of the embodiments. Also, constituent elements not essential to the description of the embodiments are not shown in the drawings referenced below.

First Embodiment

FIG. 1 is a diagram showing an overall configuration of an image forming apparatus according to the present embodiment. The image forming apparatus includes four image forming stations corresponding to yellow, magenta, cyan, and black colors. Note that the letters a, b, c, and d appended to the reference numbers in FIG. 1 respectively indicate that the corresponding members belong to the image forming stations that form yellow, magenta, cyan, and black toner images. Reference numbers not appended with letters will be used in the following description when there is no need to distinguish between the colors.

When the imaging formation begins, each member of the image forming apparatus is driven to rotate in the direction indicated by the corresponding arrow in the figure. A charging roller 2 charges the surface of a photosensitive member 1 uniformly to a predetermined potential. The photosensitive member serves as an image carrier. An exposure device 3 scans, and exposes to light, the surface of the photosensitive member 1 according to an image signal that corresponds to the image to be formed, and forms an electrostatic latent image on the surface of the photosensitive member 1. A developing sleeve 41 of a developing device 4 outputs a developing bias generated by superimposing a square-wave pulse voltage on a DC voltage, thereby causing toner to adhere to the electrostatic latent image on the photosensitive member 1 so that a toner image is formed on the surface of the photosensitive member 1. In other words, the developing device 4 develops the electrostatic latent image on the image carrier by using developer. Note that the developing bias is supplied from a developing high-voltage unit, which is not shown in the drawing. A primary transfer roller 53 outputs a primary transfer bias and transfers the toner image formed on the photosensitive member 1 to an intermediate transfer belt 51. Note that a multicolor toner image is formed on the intermediate transfer belt 51 by transferring the toner images formed on the photosensitive members 1*a*-1*d* to the intermediate transfer belt 51 such that the toner images overlap each other. A cleaner 6 collects toner that remains on the photosensitive member 1 without being transferred to the intermediate transfer belt 51. The toner image transferred to the intermediate transfer belt 51 is conveyed by the rotation of the intermediate transfer belt 51 to a position opposing a secondary transfer roller 57. The secondary transfer roller 57 outputs a secondary transfer bias, and transfers the toner image on the intermediate transfer belt 51 onto a recording material P conveyed along a conveying path 56. A cleaner 55 collects toner that remains on the intermediate transfer belt 51 without being transferred to the recording material P. The recording material P with the transferred toner image thereon is subjected to pressure and heat applied by a fixing device 7, and thus the toner image is fixed. The recording material P with the fixed toner image thereon is then discharged to the outside of the image forming apparatus.

Figure 3:
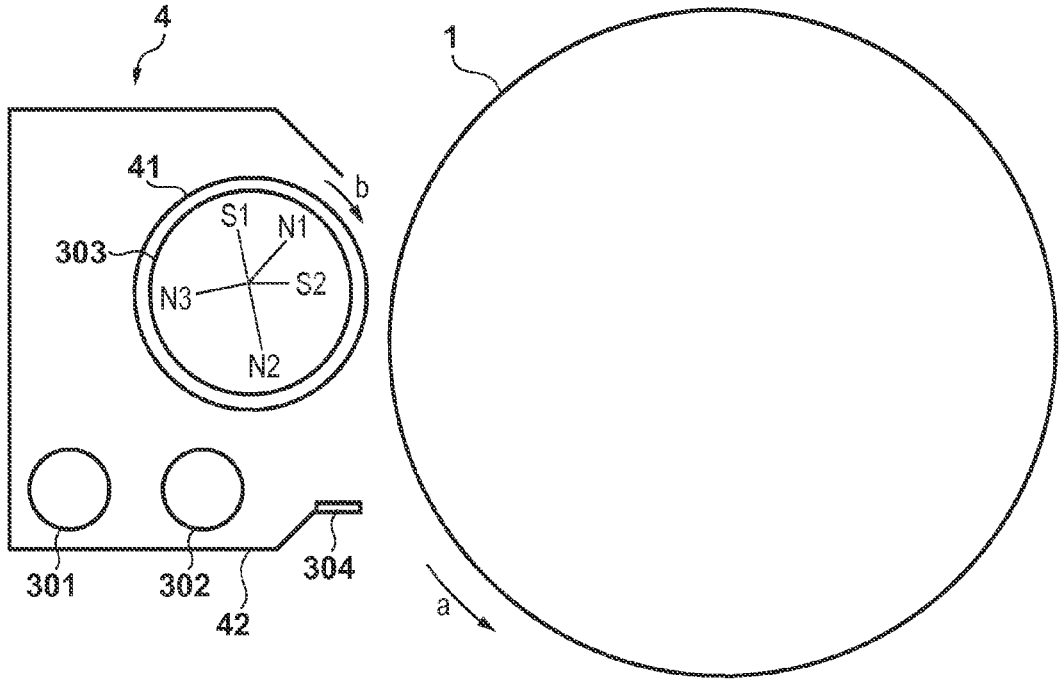
FIG. 3 is a diagram showing a configuration of a developing device according to an embodiment.

FIG. 3 shows the configuration of the developing device 4 according to the present embodiment. Note that the arrow a indicates the rotation direction of the photosensitive member 1. A developing sleeve 41 is provided near the opening of a container 42 of the developing device 4. The developing sleeve 41 is a non-magnetic member, and is driven to rotate during image formation in the direction indicated by the arrow b. A magnet roller 303 is disposed inside the developing sleeve 41. Note that the magnet roller 303 is not rotated. The magnet roller 303 has a developing magnetic pole S2, a transporting magnetic pole S1 for transporting the developer, and other magnetic poles N1, N2, and N3. Note that the magnetic poles S and N shown in FIG. 3 are interchangeable. The developer is a two-component developer including non-magnetic toner and magnetic carrier, and is carried by the surface of the developing sleeve 41 owing to the action of the magnet roller 303, and is conveyed to a developing area. Note that the developing area is the area in which the toner on the developing sleeve 41 is supplied to the photosensitive member 1. The developing area includes an opposing position opposing the developing sleeve 41 and the photosensitive member 1, and an area near the opposing position. After the toner in the developer is used for the development in the developing area, the remaining portion of the developer is conveyed to the magnetic pole N2 located downstream from the developing area in the rotation direction of the developing sleeve 41. The magnetic pole N3 located downstream from the magnetic pole N2 in the rotation direction of the developing sleeve 41 has the same polarity as the magnetic pole N2, and therefore a repulsive magnetic field is generated between them. Due to the presence of this repulsive magnetic field, the developer carried by the developing sleeve 41 is stripped from the surface of the developing sleeve 41. On the other hand, in the vicinity of the position corresponding to the magnetic pole N3, the developing sleeve 41 carries new developer by the action of the magnetic pole N3.

As described above, the developer is carried to the vicinity of the magnetic pole N2 according to the rotation of the developing sleeve 41. Since the magnetic pole N2 and the magnetic pole N3 have the same polarity, a prominent magnetic brush is formed from the developer along the magnetic field lines. For this reason, in the vicinity of the magnetic pole N2, some portions of the developer collide with each other, and some other portions of developer collide with the container 42 of the developing device 4 opposing the magnetic pole N2. The impact of such collision causes the magnetic carrier and the toner to separate from each other. The toner separated and scattered outside the developing device 4 makes the inside of the image forming apparatus dirty. For this reason, as shown in FIG. 3, a prevention electrode 304 is provided downstream from the developing area of the developing sleeve 41, at the position opposing the developing sleeve 41. The prevention electrode 304 may be, for example, located near the gap between the container 42 of the developing device 4 and the developing sleeve 41, on the inside surface of the container 42. To prevent the toner from being scattered, the prevention electrode 304 may be located upstream from the magnetic pole N2 in the rotation direction of the developing sleeve 41 so as to face the developing sleeve 41. The prevention electrode 304 needs to apply a bias having the same polarity as the toner so that the toner carried by the developing sleeve 41 adheres to the developing sleeve and the toner is prevented from being scattered outside the developing device 4. For this reason, the prevention bias output from the prevention electrode 304 is on the same side in terms of polarity as the toner with respect to the DC component (developing DC bias) of the developing bias output by the developing sleeve 41. Note that, in the configuration shown in FIG. 3, developing screws 301 and 302 are provided for stirring and conveying the developer in the axis direction of the developing sleeve 41.

Figure 2:
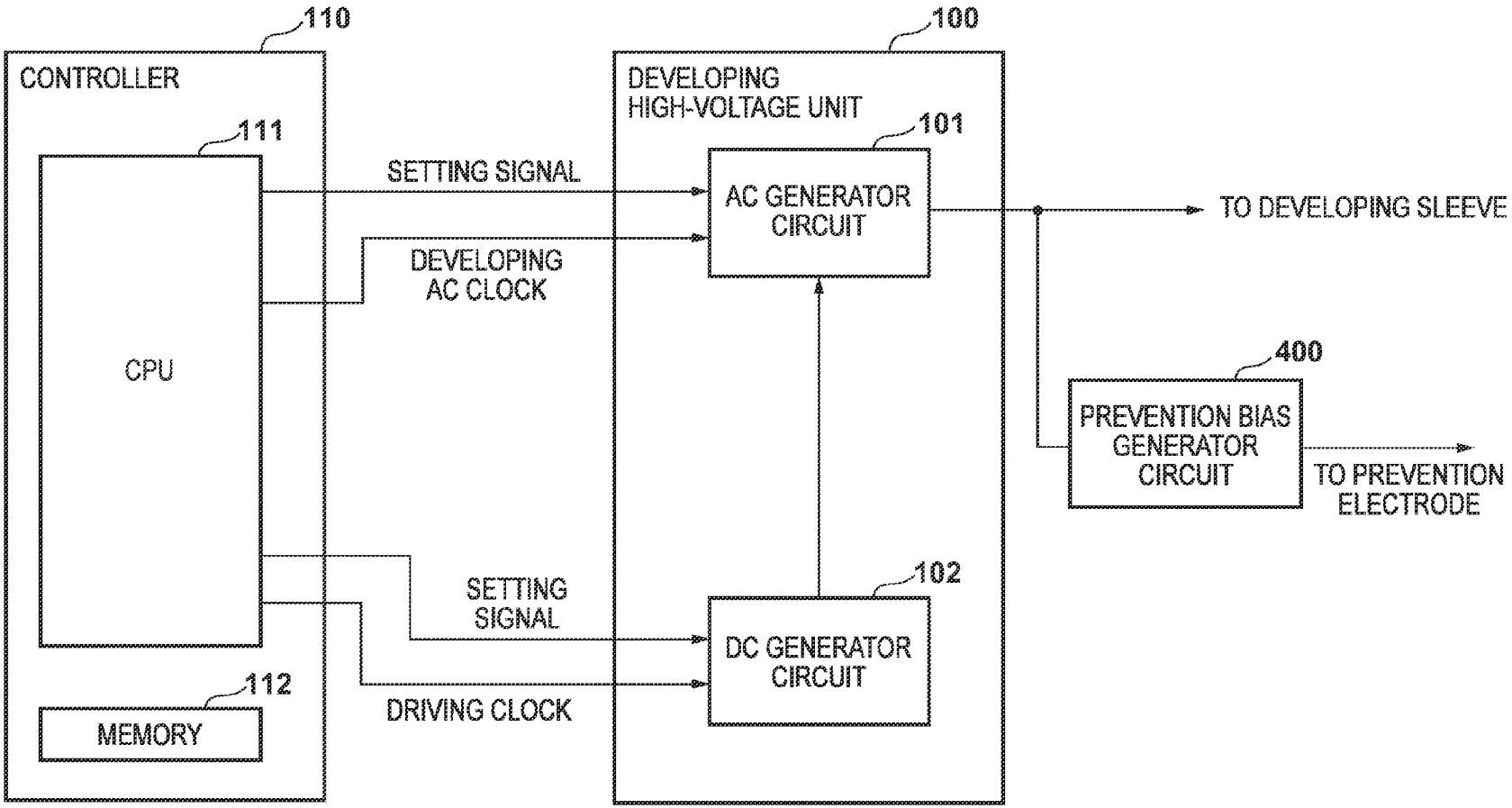
FIG. 2 is a diagram showing a control structure of the image forming apparatus according to an embodiment.

FIG. 2 shows a control structure for generating the developing bias and the prevention bias. A controller 110 includes a CPU 111 that controls the entirety of the image forming apparatus, and a memory 112 that stores a program to be executed by the CPU 111. A developing high-voltage unit 100 includes an AC generator circuit 101 that generates a developing AC bias and a DC generator circuit 102 that generates a developing DC bias. The CPU 111 outputs, to the AC generator circuit 101, a setting signal that sets a peak-to-peak value (hereinafter, "Vpp") of the developing AC bias, and a developing AC clock that determines the frequency of the developing AC bias. Also, the CPU 111 outputs, to the DC generator circuit 102, a setting signal that sets the value of the developing DC bias, and a driving clock that drives a transformer provided within the DC generator circuit 102.

The DC generator circuit 102 generates a developing DC bias according to an instruction from the CPU 111. The AC generator circuit 101 generates a developing AC bias according to the frequency and Vpp notified by the CPU 111. Then, the AC generator circuit 101 superimposes the developing AC bias thus generated onto the developing DC bias generated by the DC generator circuit 102, thereby generating a developing bias, and outputs the developing bias. In other words, the developing high-voltage unit 100 serves as a developing bias output unit. The developing bias output by the developing high-voltage unit 100 is applied to the developing sleeve 41. The developing bias is also output to a prevention bias generator circuit 400.

Figure 4:
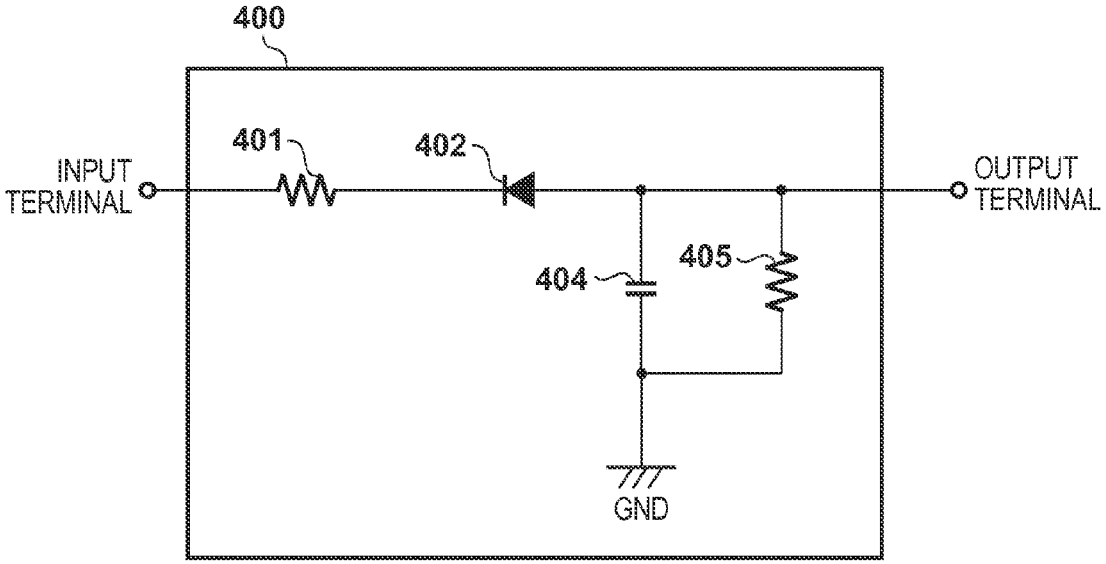
FIG. 4 is a diagram showing a configuration of a prevention bias generator circuit according to an embodiment.

FIG. 4 shows the configuration of the prevention bias generator circuit 400 according to the present embodiment. The developing bias generated by the developing high-voltage unit 100 is input to the input terminal of the prevention bias generator circuit 400. As shown in FIG. 4, a resistor 401 is connected between the input terminal and the cathode of a diode 402. The resistor 401 is provided in order to avoid that when there is a decrease in the impedance of the output side of the prevention bias generator circuit 400, the decrease has an influence on the developing bias on the input side. One terminal of a capacitor 404 is connected to the anode of the diode 402, and the other terminal of the capacitor 404 is connected to the ground (GND). The diode 402 and the capacitor 404 connected in series constitute a rectifier circuit. A resistor 405 is connected to the capacitor 404 in parallel. The resistor 405 is a bleeder resistor connected to a load in parallel in order to discharge the capacitor 404. The diode 402 and the capacitor 404 rectifies the peaks of the developing bias input to the input terminal, and outputs the rectified voltage as the prevention bias from the output terminal. In other words, the prevention bias generator circuit 400 outputs a prevention bias generated by holding the negative-side peak value of the developing bias. Note that the prevention bias in reality output from the output terminal is approximately 0.9 times the negative-side peak value of the developing bias due to the occurrence of the forward voltage drop across the diode 402 and the voltage drop across the bleeder resistor 405.

Figure 5:
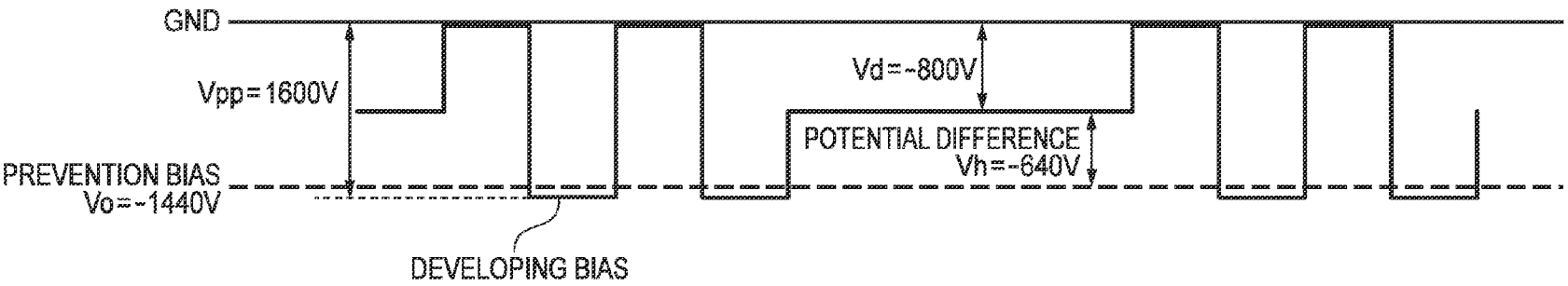
FIG. 5 is a diagram showing the relationship between a developing bias and a prevention bias in the prevention bias generator circuit shown in FIG. 4.
Figure 9:
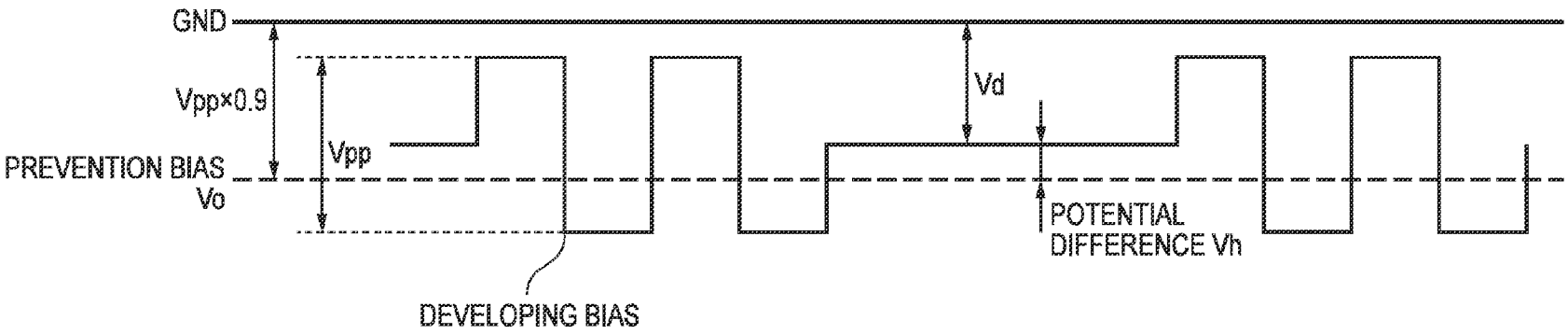
FIG. 9 is a diagram showing the relationship between a developing bias and a prevention bias in the prevention bias generator circuit shown in FIG. 8.

FIG. 5 shows the relationship within the prevention bias generator circuit 400 among the developing DC bias, the developing AC bias, and the prevention bias. In the example shown in FIG. 5, the developing DC bias Vd is −800V, and the peak-to-peak value Vpp of the developing AC bias is 1600V. Therefore, the negative-side peak value of the developing bias is Vd−Vpp/2=−1600V. As already described above, the value of the prevention bias to be output is approximately 0.9 times the negative-side peak value of the developing bias, and accordingly, in the example of voltages shown in FIG. 5, the prevention bias Vo output from the prevention bias generator circuit 400 is approximately −1440V. Therefore, the potential difference Vh between the prevention bias Vo and the developing DC bias is −640V. As already described above, in order to prevent the developer from being scattered, the prevention bias needs to have the same polarity as the developing DC bias, the value thereof needs to be greater on the negative side than on the positive side, and the potential difference needs to be equal to or greater than a predetermined value. Here, assume that the predetermined value is 400V.

FIG. 6 shows how the potential difference Vh varies depending on Vpp of the developing AC bias. Note that the prevention bias generator circuit 400 is the circuit shown in FIG. 4 and the prevention bias generator circuit 900 is the circuit shown in FIG. 8. In both cases, the developing DC bias Vd is −800V, and the value of the prevention bias is assumed to be 0.9 times the ideal value due to, for example, the occurrence of a voltage drop across the diode. When Vpp of the developing AC bias is 1600V, the prevention bias generator circuit 400 outputs a prevention bias of −1440V as described above. The prevention bias generator circuit 900 outputs a prevention bias having the same value, i.e., −1440V, because the value of the prevention bias is 0.9 times the value of Vpp. Therefore, in both cases, the potential difference Vh is 640V, which is greater than the predetermined value, 400V.

When Vpp of the developing AC bias is 1200V, the negative-side peak value of the developing bias is −800−1200/2=−1400V. Therefore, the prevention bias Vo output by the prevention bias generator circuit 400 is −1400×0.9=−1260V. Even in this case, the potential difference Vh is 460V, which is greater than the predetermined value, 400V. In contrast, the prevention bias Vo output by the prevention bias generator circuit 900 is −1200×0.9=−1080V, and the potential difference Vh is 280V. That is, when Vpp of the developing AC bias is 1200V, the prevention bias generator circuit 900 cannot achieve the required potential difference, 400V.

As described above, the present embodiment is configured to output a prevention bias generated by holding the negative-side peak value of the developing bias. This configuration widens the setting range of the developing bias that can achieve the potential difference Vh required for preventing or suppressing the toner from being scattered.

Second Embodiment

Next, a description is given to a second embodiment, focusing mainly on differences from the first embodiment. FIG. 7 shows the configuration of the prevention bias generator circuit 700 according to the present embodiment. The prevention bias generator circuit 700 is different from the prevention bias generator circuit 400 shown in FIG. 4 in that there are two input terminals, namely a first input terminal and a second input terminal, and the potential of the part that is connected to the ground (GND) in the case of the prevention bias generator circuit 400 is set at the same potential as the developing DC bias. Therefore, the second input terminal is supplied with, for example, the developing DC bias from the DC generator circuit 102 shown in FIG. 2. Note that the first input terminal of the prevention bias generator circuit 700 is supplied with the same developing bias as supplied to the input terminal of the prevention bias generator circuit 400. Also note that the connection configuration of the resistors, the capacitor, and the diode of the prevention bias generator circuit 700 is the same as the prevention bias generator circuit 400 except for GND. In the present embodiment, the respective terminals of the bleeder resistor 405 and the capacitor 404 on the opposite side as the terminals connected to the diode 402 are set at the potential of the developing DC bias, not zero. Therefore, the prevention bias cannot be smaller than the developing DC bias. Furthermore, as the terminal of the bleeder resistor 405 on the opposite side as the terminal connected to the diode 402 is set at the potential of the developing DC bias, the influence of the voltage drop across the bleeder resistor 405 is reduced. Specifically, the prevention bias that is approximately 0.95 times the negative-side peak value of the developing bias can be output.

Furthermore, when compared with the case of the first embodiment, the voltage applied to the bleeder resistor 405 is smaller, and accordingly a resistor that can withstand a lower voltage may be used as the bleeder resistor 405, which leads to cost reduction. For example, when the developing DC bias Vd=−800V and a prevention bias of −1440V is output, the bleeder resistor 405 in the prevention bias generator circuit 400 is supplied with a voltage of 1440V, and accordingly a resistor that is capable of withstanding a voltage of 2 k V needs to be used. In contrast, in the case of the prevention bias generator circuit 700, the bleeder resistor 405 is supplied with a voltage of 640V, and the resistor that is capable of withstanding a voltage of only 1 k V can be used. As described above, the present embodiment achieves the additional effect of reducing the cost of the parts to be used, as well as the effect of the first embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-105668, filed on May 21, 2014, which is hereby incorporated by reference herein in its entirety.

What is claimed is:

1. A developing device for developing an electrostatic latent image on an image carrier by using developer, comprising:

a developing bias output unit configured to output a developing bias generated by superimposing an AC bias on a DC bias;

a developing sleeve supplied with the developing bias output from the developing bias output unit;

a prevention bias generator unit configured to generate a prevention bias by holding a peak value of the developing bias of the superimposed AC bias and DC bias, the prevention bias suppressing scattering of developer carried by the developing sleeve; and an electrode, disposed at a position opposing the developing sleeve, configured to output the prevention bias, wherein the prevention bias generator unit includes:

a resistor supplied with the developing bias of the superimposed AC bias and DC bias;

a diode supplied with the developing bias of the superimposed AC bias and DC bias, a cathode of the diode being connected to the resistor in series; and a capacitor, with a terminal of the capacitor being connected to ground and another terminal of the capacitor being connected to an anode of the diode, and wherein the prevention bias generator unit outputs, as the prevention bias, a potential of the anode of the diode.

2. The developing device according to claim 1, wherein the electrode, which is disposed at the position opposing the developing sleeve, is disposed downstream from a developing area in a rotation direction of the developing sleeve, the developing area being an area in which developer carried by the developing sleeve is supplied to the image carrier by the developing bias.

3. The developing device according to claim 2, wherein the developing sleeve includes a first magnetic pole and a second magnetic pole located downstream from the developing area in the rotation direction, the first magnetic pole and the second magnetic pole have the same polarity, the second magnetic pole is located downstream from the first magnetic pole in the rotation direction, and the electrode is located upstream from the first magnetic pole in the rotation direction.

4. The developing device according to claim 1, wherein the electrode is located in a gap between the developing sleeve and a container of the developing device.

5. The developing device according to claim 1, wherein the prevention bias generator unit is further configured to hold a peak value on a same side in terms of polarity as developer carried by the developing sleeve with respect to the DC bias.

6. A developing device for developing an electrostatic latent image on an image carrier by using developer, comprising:

a developing bias output unit configured to output a developing bias generated by superimposing an AC bias on a DC bias;

a developing sleeve supplied with the developing bias output from the developing bias output unit;

a prevention bias generator unit configured to generate a prevention bias by holding a peak value of the developing bias, the prevention bias suppressing scattering of developer carried by the developing sleeve; and an electrode, disposed at a position opposing the developing sleeve, configured to output the prevention bias, wherein the prevention bias generator unit includes:

a first resistor supplied with the developing bias;

a diode, with a cathode of the diode being connected to the first resistor in series; and a capacitor, with a terminal of the capacitor being supplied with a potential of the DC bias and another terminal of the capacitor being connected to an anode of the diode, and wherein the prevention bias generator unit outputs, as the prevention bias, a potential of the anode of the diode.

7. The developing device according to claim 6, wherein the prevention bias generator unit further includes a second resistor connected to the capacitor in parallel.

8. An image forming apparatus comprising:

a forming unit configured to form an electrostatic latent image on an image carrier; and a developing device configured to develop the electrostatic latent image formed by the forming unit, wherein the developing device includes:

a developing bias output unit configured to output a developing bias generated by superimposing an AC bias on a DC bias;

a developing sleeve supplied with the developing bias output from the developing bias output unit;

a prevention bias generator unit configured to generate a prevention bias by holding a peak value of the developing bias of the superimposed AC bias and DC bias, the prevention bias suppressing scattering of developer carried by the developing sleeve; and an electrode, disposed at a position opposing the developing sleeve, configured to output the prevention bias, wherein the prevention bias generator unit includes:

a resistor supplied with the developing bias of the superimposed AC bias and DC bias;

a diode supplied with the developing bias of the superimposed AC bias and DC bias, a cathode of the diode being connected to the first resistor in series; and a capacitor, with a terminal of the capacitor being connected to ground and another terminal of the capacitor being connected to an anode of the diode, and wherein the prevention bias generator unit outputs, as the prevention bias, a potential of the anode of the diode.

9. An image forming apparatus comprising:

a forming unit configured to form an electrostatic latent image on an image carrier;

a developing bias output unit configured to output a developing bias generated by superimposing an AC bias on a DC bias;

a developing sleeve supplied with the developing bias output from the developing bias output unit;

a prevention bias generator unit configured to generate a prevention bias by holding a peak value of the developing bias, the prevention bias suppressing scattering of developer carried by the developing sleeve; and an electrode, disposed at a position opposing the developing sleeve, configured to output the prevention bias, wherein the prevention bias generator unit includes:

a resistor supplied with the developing bias;

a diode, with a cathode of the diode being connected to the resistor in series; and a capacitor, with a terminal of the capacitor being supplied with a potential of the DC bias and another terminal of the capacitor being connected to an anode of the diode, and wherein the prevention bias generator unit outputs, as the prevention bias, a potential of the anode of the diode.

* * * * *